United States Patent [19]

Flinchbaugh

[11] 4,046,226

[45] Sept. 6, 1977

[54] ELEVATOR SYSTEM FOR TRANSPORTING WHEELCHAIR PATIENTS

[75] Inventor: Henry K. Flinchbaugh, York, Pa.

[73] Assignee: Flinchbaugh-Murray Corporation, York, Pa.

[21] Appl. No.: 703,636

[22] Filed: July 8, 1976

[51] Int. Cl.[2] ..... B66B 9/08

[52] U.S. Cl. ..... 187/12; 187/95

[58] Field of Search ..... 187/12, 13, 14, 10, 187/20, 95

[56] References Cited

U.S. PATENT DOCUMENTS

| | | | |
|---|---|---|---|
| 1,768,650 | 7/1930 | Wood | 187/12 |
| 1,838,204 | 12/1931 | Wood | 187/12 |
| 1,993,309 | 3/1935 | Rubin | 187/12 |
| 2,563,260 | 8/1951 | Miller | 187/12 |
| 2,674,347 | 4/1954 | Thompson | 187/12 |
| 2,950,948 | 8/1960 | Hardigan et al. | 187/12 |
| 3,121,476 | 2/1964 | Mazzarelli | 187/12 |
| 3,312,307 | 4/1967 | Camp | 187/10 |
| 3,592,294 | 7/1971 | Allen | 187/12 |
| 3,662,859 | 5/1972 | Flinchbaugh | 187/12 |
| 3,833,092 | 9/1974 | Flinchbaugh | 187/12 |

*Primary Examiner*—Evon C. Blunk
*Assistant Examiner*—Jeffrey V. Nase
*Attorney, Agent, or Firm*—Paul & Paul

[57] ABSTRACT

An elevator platform rides on parallel tracks which may be adapted for vertical or inclined conveyance. Each track is slotted along its length, through which slot the platform extends and is connected to a trolley driven by a continuous chain. Each track is tubular and generally rectangular, and each encloses another tubular, rectangular member which provides a space for the chain return and electrical conduits, and which provides support for the trolley. Each trolley has an upper pair of rollers bearing against the inside of the hollow track straddling the slot, and lower rollers bearing against the top surface of the inner tubular member. Interrupt and safety precautions are provided based on chain breakage, excessive speed, overload, or contact with foreign objects in the path of the elevator platform.

12 Claims, 11 Drawing Figures

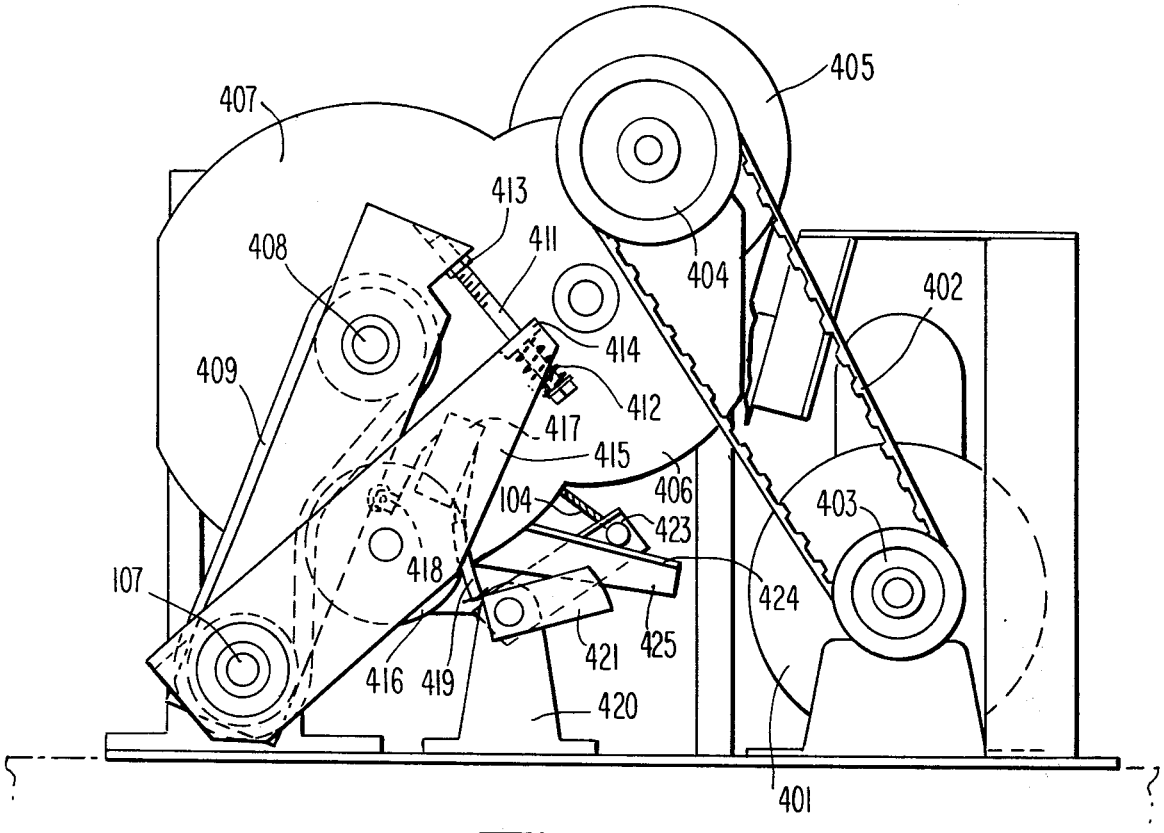
Fig. 4a
Fig. 4b
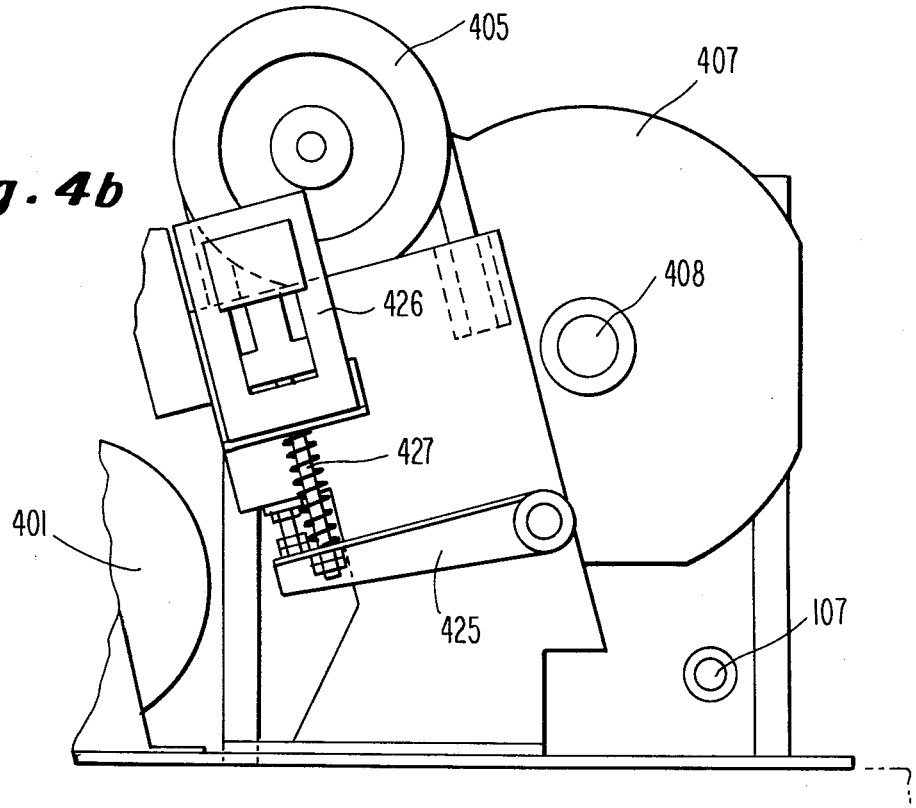

ELEVATOR SYSTEM FOR TRANSPORTING WHEELCHAIR PATIENTS

BACKGROUND OF THE INVENTION

This invention relates to elevator systems, and more particularly to those elevator systems having a track enclosed trolley system powered by a drive means remote from the platform.

The art of elevator system design is an active one, featuring many alternative approaches. One particularly large class of elevator systems are those adapted to operate on an incline, such as along a staircase for conveyance of wheelchair patients. In this class of system, the prior art is relatively extensive. Generally, however, all such systems have similar objectives, relating to simplicity and safety of design, ease of use, and minimal occlusion of the stairway. The present invention is also generally directed to these objectives.

In one significant subclass of inclined elevator system, the power source is integral with the elevator platform, and operates to move the platform up and down the incline either by the winding and unwinding of cable, or by the operation of a threaded shaft engaging nuts which move therealong. See, for example, my prior U.S. Pat. Nos. 3,662,859 and 3,833,092.

In another class of system, a discrete power source operates trolleys riding upon or enclosed within a track, and the elevator platform is attached to the trolleys. See, for example, U.S. Pat. Nos. 1,933,309, 2,950,948, 3,312,307, and 3,121,476.

In many respects the latter class of system has advantages in that the removal of the power source from the platform allows for a less encumbered stairway, and for lighter, less obtrusive elevator platforms.

The present invention is directed to the latter class of system (i.e., those with remote drive sources and track enclosed trolleys), but is intended further to simplify and reduce the size of the apparatus involved. In particular, it is an object of the present invention to provide an elevator mechanism which, when mounted on a staircase, is of compact and rigid construction, conserves space on the stairway, presents a compact and neat appearance, and yet is flexible in assembly for accommodating various configurations of building constructions. Further, the present invention is directed to provision for a configuration which may simply and conveniently be mounted and used by handicapped or other incapacitated persons, yet which minimally affects the appearance and function of the staircase for its normal use.

Another important objective of the present invention relates to its flexibility of design. That is, it is a principal object of the present invention that the apparatus and design useful for inclined elevator systems such as along a staircase be directly adaptable for use in vertical elevator systems. That is, the present invention is directed to elevator-track-trolley combinations, powered by discrete drive means, which are directly applicable both to inclined and vertical elevator systems. Correspondingly, the safety aspects of the system must be reliable and efficient for either configuration.

SUMMARY OF THE INVENTION

The present invention involves a track of generally rectangular tubing defining a hollow passageway in which a trolley is movable under power of a continuous chain driven by a discrete power source. The passageway in the track is defined by an outer rectangular tubular member and another rectangular tubular member within the outer member. The platform extends horizontally from a slot in the tubular track, were it connects with the trolley. The upper end of the trolley includes rollers which straddle the slot and bear against the inside top of the passageway, and the lower end of the trolley includes rollers which bear in the opposite direction, thereby resolving the torque created by the loading of the horizontal platform.

The foregoing design allows considerable facility for safety features. Emergency switches on the platform provide power disablement upon contact of the platform with an object in its path, and switch means along the track are operated by contact with the trolley also to control the power. Safety pawls on the trolley provide stoppage of motion in a broken chain or excessive speed situation, and a cable release along the track allows the user to control the braking of the power source in an emergency situation.

DESCRIPTION OF THE DRAWINGS

FIGS. 4*a* and 4*b* show opposing side views of a drive system in accordance with the principles of the present invention.

DETAILED DESCRIPTION

Figure 1A:
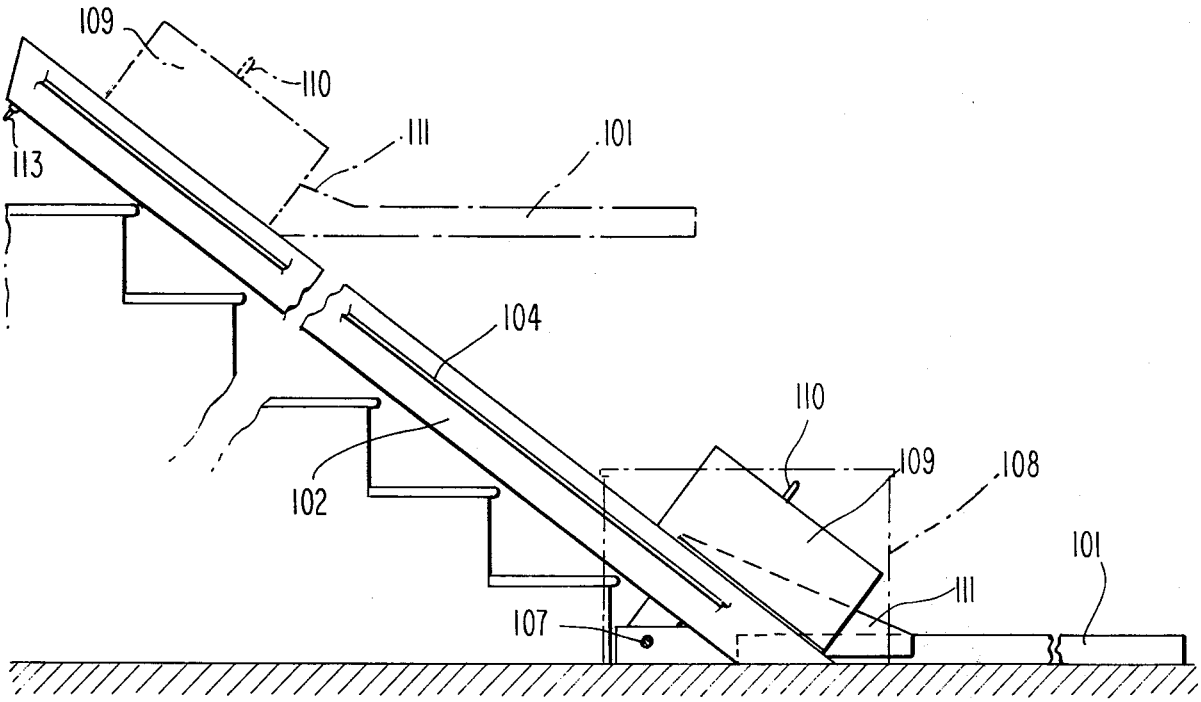
FIGS. 1*a* and 1*b* show side and frontal views of an elevator system embodying the principles of the present invention.
Figure 1B:
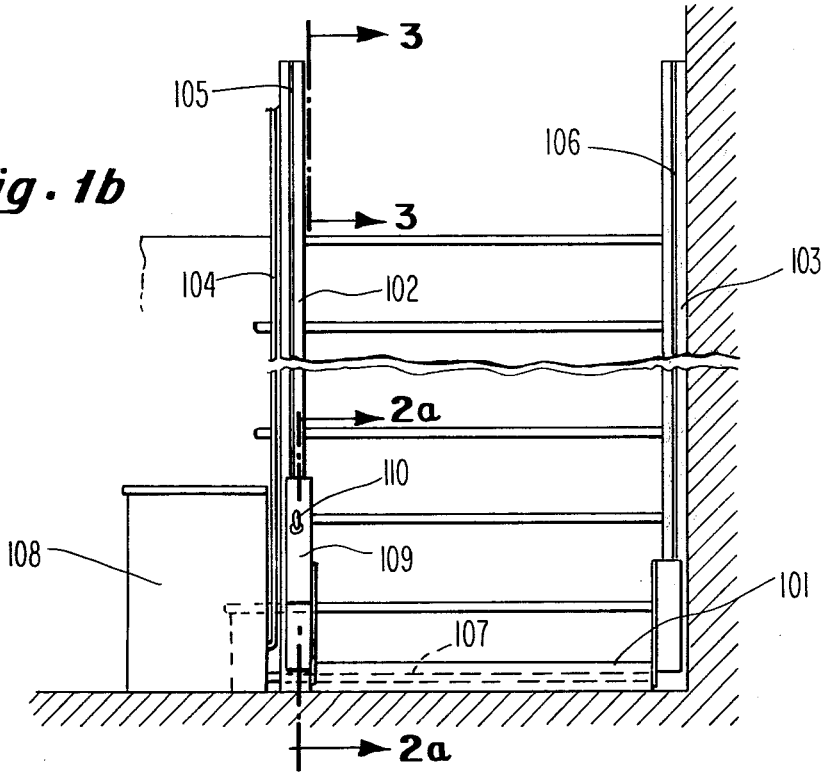

Referring first to FIGS. 1*a* and 1*b*, there are shown side and front views of an illustrative embodiment of the present invention adapted to function as an inclined elevator along a stairway. Tracks 102 and 103 are disposed along the toes of the steps of the stairway, and a platform 101 depends horizontally outward from the tracks 102 and 103. Those tracks are tubular and generally rectangular in configuration, and each defines a longitudinal slot 105 and 106 in their top surface. As described hereinafter, trolleys move in passageways defined by the tubular tracks 102 and 103, and the platform 101 is connected to the trolleys by means of an extension, not shown in FIGS. 1*a* and 1*b*, from structural element 111 of platform 101 down into the respective slots 105 and 106. Hence, as the trolleys move upstairs or downstairs within the tracks 102 and 103, the platform 101 correspondingly moves up and down the stairway. Two positions of the platform 101 are shown in FIG. 1*a*.

The trolleys within tracks 102 and 103 are driven by chains connected thereto and forming a continuous loop, each of which is powered by drive means within a suitable enclosure 108, and a drive shaft 107. This driving operation is also discussed in detail hereinafter.

The electrical interconnections of the apparatus of FIGS. 1*a* and 1*b* are specified in greater detail hereinafter, but some will be apparent from FIGS. 1*a* and 1*b*. Attached to and movable with the platform 101 is an enclosure 109 housing electrical cord reels and switching apparatus. Hence, an on-off switch 110 on the platform, and other safety switches also on the platform and discussed hereinafter, are coupled via the cord reels enclosed at 109, outside the track 102, and down into the power drive enclosure 108. As the platform 101 moves up and down the staircase, the reels enclosed at 109 play out cable, but maintain a suitable tensioned state between the platform 101 and the power drive 108 to avoid tangling, fouling, and the like.

At the top of track 102 is another manual on-off switch 113 which is connected to the power drive unit enclosed at 108 via conduits through track 102, which are described hereinafter.

A cable 104 is shown connected outside the track 102, in a fashion which is reachable without difficulty by a person on the platform 101. Cable 104 is connected to a safety brake release, described hereinafter, and functions to release the brake, as desired, to override emergency braking operations which are electrically actuated and which are discussed hereinafter.

FIG. *2a* shows a cross sectional view of the lower extremity of track 102 whenever platform 101 is in its lowermost position as shown in FIG. *1a*. FIG. *2b* shows a top cut away of FIG. *2a*, and FIG. *2c* shows a transverse cut away of FIG. *2b*. From FIGS. *2a* through *2c*, it will be appreciated that the track 102 is defined by a generally rectangular tubular member 102 having a longitudinal slot centrally located on the top surface thereof. Within the outer tubular member 102 and on the bottom surface thereof is another generally rectangular tubular member 220 which defines a passageway for return of the continuous drive chain 203 from the top extremity of the track 102, and also for an electrical conduit 221 containing assorted electrical connections 222 from the upper reaches of the system. The space between the top surface of the inner tubular member 220 and the slotted upper surface of the outer tubular member 102 defines a generally rectangular passageway for a trolley 201, to which the platform 101 is attached from its structural member 111 by a cantilever member 234, or other suitable connection as desired. It will be appreciated that a similar mechanism to that shown in FIGS. *2a* through *2c* is found in the other tubular track 103. It will also be appreciated that in alterative embodiments, only a single track such as 102 will be necessary to support and convey the elevator platform. Likewise, the orientation of the tracks 102 and 103 may be vertical as well as the inclined deposition shown, with only minor variations in the structure required for the change.

The trolley 201 utilizes two pairs of rollers. A first or upper pair 207 and 236 bears against the inside upper surface of tubular member 102, straddling the slot 105 therein. A lower pair of rollers 219 and 239 bears against the top surface of the inner tubular member 220. Thus, although alterative embodiments of the present invention may entail additional upper or lower roller assemblies, the two pairs shown will generally be sufficient, and the loading torque applied by the platform 101 and any weight thereon will force the rollers against their appropriate associated running surfaces. Advantageously, the rollers 207, 236, 219, and 239 are free running on suitable bearing assemblies.

The drive chain 203 is directly connected to the lowermost extremity of trolley 201, passes over sprockets 231, 227, and 223 as shown, and extends upwardly through tubular member 220 as shown. With brief reference to FIG. 3, it will be noted that the chain 203 extends through tubular member 220 to the upper extremity of track 102, where it passes over a sprocket 305. Thence, the chain 203 extends through the trolley passageway and connects with a pair of pivotable pawls 204 and 235 near the upper extremity of trolley 201. The pawls 204 are pivotable about point 205, have a toothed surface 209 opposite the connection point with chain 203, and normally are maintained in the position shown in FIGS. *2a* and 3 by tension of the chain 203. Should the chain 203 break, however, a spring 206 pivots the pawls 204 such that the teeth 209 engage the top surface of inner tubular member 220, and stop the trolley 201 in that position.

Intermediate the upper and lower roller assemblies on the trolley 201 is a pawl mechanism which operates as a speed safety. Specifically, a pair of pawls 208 and 237 is pivoted at point 211 and each has a lower serrated portion such as 210. The pawls 208 and 237 operate in conjunction with each other, and in the normal condition are maintained in the position shown in FIG. *2a* by spring control (not shown) at their interconnecting pivot shaft 211. Pawl 208 has an extension 234 which extends just to the outer periphery of a wheel 212. The wheel 212 is urged against the inside upper surface of tubular member 102 by means of a spring 213, and has a series of teeth 214, 215, 216, and 217 freely pivotable thereon. A ridge 218 surrounds the lower portion of wheel 212, and maintains the teeth such as 216 and 217 in the position shown against gravitational forces. That is, the teeth 214 through 217 freely pivot in the normal course only under the influence of gravity, and the ridge 218 maintains them in position at the bottom turn of wheel 212. During upward movement of the trolley 201, or during downward movement of trolley 201 at acceptable speeds, the teeth 214 through 217 stay in the position shown, and do not engage portion 234 of pawl 208. Should the downward speed of trolley 201 become excessive, centrifugal force will pivot the teeth 214 through 217 outwardly, engage portion 234 of pawl 208, and pivot the pawl downwardly until the teeth 210 engage the upper surface of inner tubular member 220, and stop the motion of the trolley. It will be noted that teeth such as 214 through 217 may be included both on wheels 212 and 238, but generally that would be a redundant configuration, and wheel 238 may satisfactorily be a standard roller.

An automatic power shut-off is provided by a power limit switch 228 enclosed near the bottom of the inner tubular member 220. As shown, a spring lever 230 from switch 228 penetrates an opening in the upper surface of tubular member 220, and is downwardly deflected by roller 219 whenever the trolley 201 is at its lowermost extremity. The switch 228 is thereby engaged, and by wiring connections not shown, disables the power drive.

Another safety feature in accordance with the principles of the present invention is represented by the sprocket structure 223, 227, and 231. That is, the chain 203 is driven from the shaft 107 by means of drive sprocket 227, but the chain 203 also passes over free running sprockets 223 and 231. As shown, both these sprockets are maintained by the chain 203 in tension against springs 224 and 232 respectively. Should there occur a breakage in chain 203, or a similar fault in the mechanism which would cause a slack in chain 203, sprockets 231 and 223 will be accordingly displaced by the tension in their respective springs 224 and 232. This displacement will result in movement of the spring lever 226 of switch 225, and consequent disablement of the power furnished to the drive shaft 107.

Figure 3:
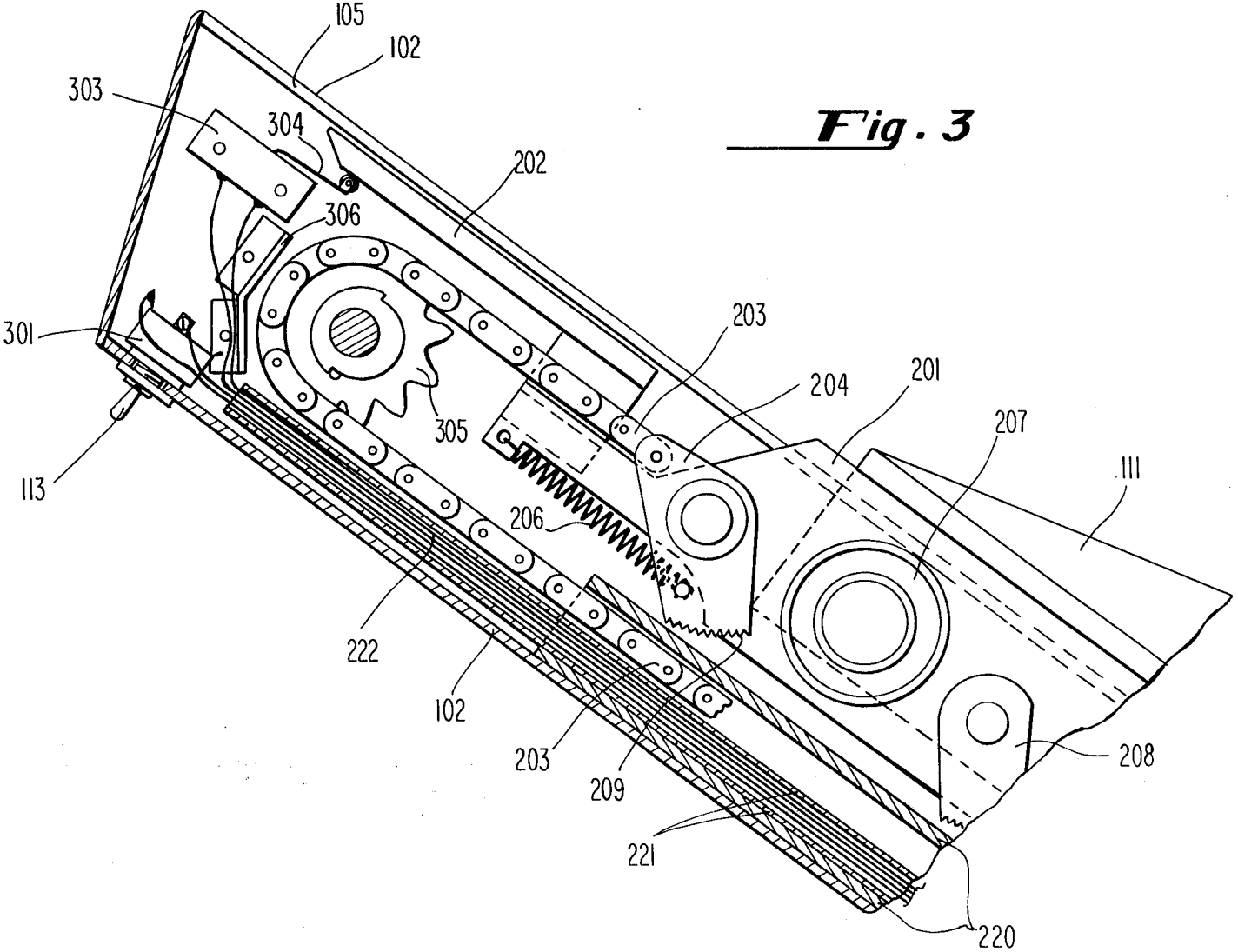
FIG. 3 shows in cut away the top extremity of the track of the embodiment of FIG. 1.

FIG. 3 shows a preferred configuration for the upper extremity of the track 102. For convenience of explanation, FIG. 3 is shown with the trolley 201 and the platform 101 at their uppermost extent of travel. As shown, when that uppermost travel is reached, an outward protrusion 202 from the top extremity of trolley 201 engages a spring lever 304 of switch 303, which disengages the power from the chain 203. Hence, when the platform 101 reaches the top of the stairs, switch 303 will automatically shut off the power. Also shown is a switch 301 which is manually operated at toggle 113. The wires from both switches 301 and 303 pass through the conduit 221 within inner tubular member 220, and down to the power source. A suitable divider 306 protects the wiring from the chain 203, sprocket 305, or other such apparatus within the main passageway.

Figure 2A:
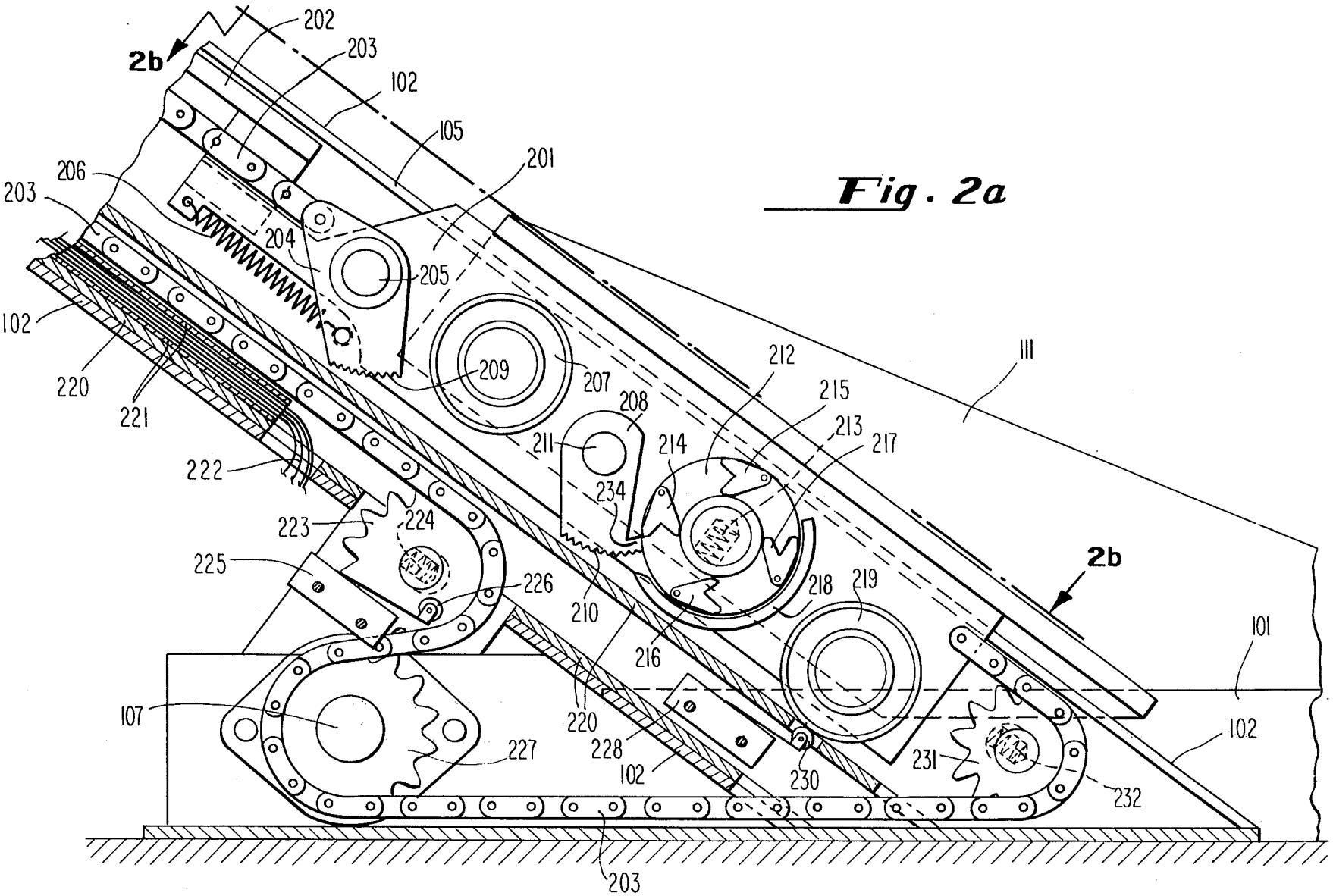
FIG. 2*a* shows a cross sectional view of the bottom track portion of the FIG. 1 system, including the chain drive sprockets and the elevator trolley.
Figure 2B:
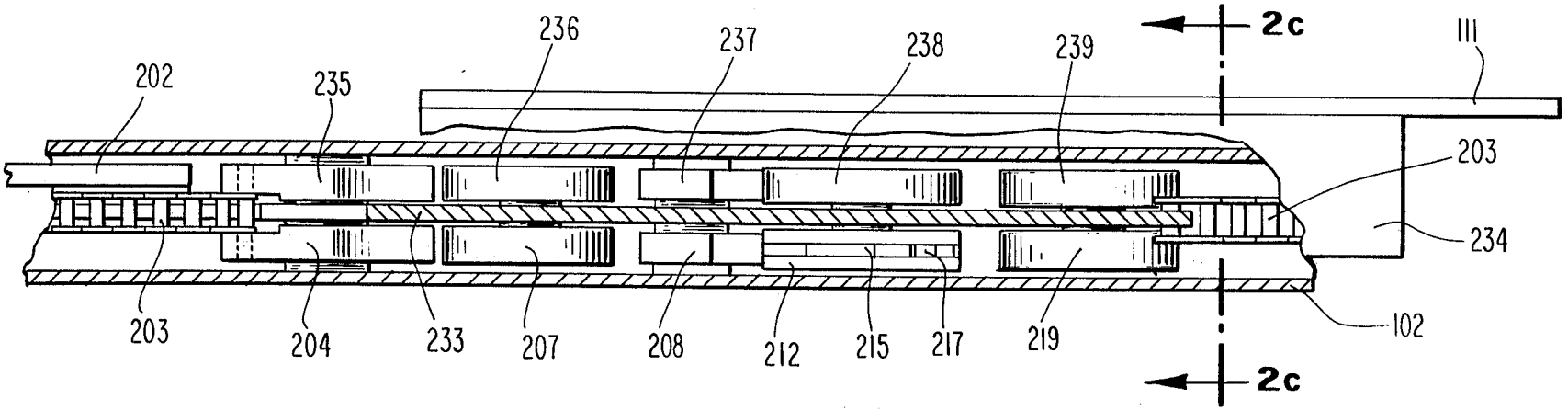
FIGS. 2*b* and 2*c* show different views for a trolley mechanism in accordance with the principles of the present invention.
Figure 2C:
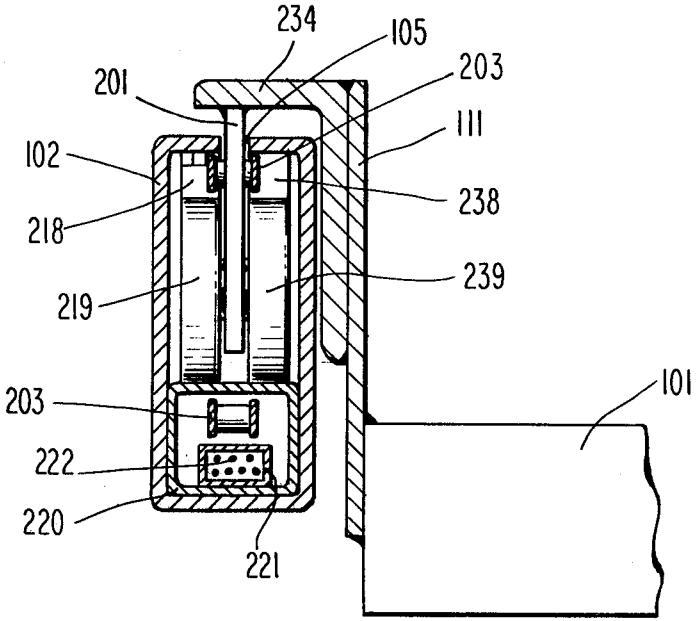

FIGS. 4*a* and 4*b* show views from opposite sides of a preferred power drive mechanism for the chain and trolley system of FIGS. 1 through 3. In its preferred form, the apparatus of FIGS. 4*a* and 4*b* is enclosed in housing 108 shown at the bottom of the staircase in FIG. 1*b*, and drives the chains and trolleys in tracks 102 and 103 by means of a drive shaft 107.

As will be noted from the figures, a suitable electric motor 401 drives a belt 402 at its output shaft 403. In turn, the belt 402 operates a geared power train 405, 406, and 407, the final output 408 of which powers a chain 409 to drive the shaft 107. As may be seen from the FIG. 4*b* view, a solenoid 426 operates against a spring push rod 427, controlling a brake lever 425 which applies braking force, as desired, against the power train. The spring 427 tends to apply braking force, and the solenoid 426 magnetically tends to release that force.

With reference to FIG. 4*a*, there is shown an overload clutch mechanism whereby excessive loads on the platform 101 will cause disengagement of power. In particular, a lever arm 415 is pivotable about the drive shaft 107 by means of an adjustable spring shaft assembly 411, 412, 413, and 414. Approximately centrally located on the arm 415 is a wheel 416 bearing against drive chain 409. In the event of an overload, spring arm 418 of switch 417 will be displaced by the chain 409, and power will be cut off via electrical connection 419.

Another feature shown in FIG. 4*a* is provision for operation of the brake lever 425 by the cable 104 referred to in conjunction with FIG. 1*a*. It will be recalled that the function of that cable is to override a power interrupt condition, and manually to permit the platform 101 to return to the bottom position on the staircase. As shown in FIG. 4*a*, the cable 104 connects to one side of a pivotable arm 423, the pivot point of which is located on a suitable pedestal 420. On the opposite side of the pedestal, but pivotable together with arm 423, is a cam 421 which when turned upwardly engages the brake lever 425. Hence, when cable 104 is pulled upwardly by a person on the platform 101, arm 423 pivots upwardly and causes cam 421 to engage a top flange 424 on the brake arm 425, in turn displacing the brake arm 425 upwardly. Since in the embodiment of FIGS. 4*a* and 4*b*, the braking normally is applied by spring 427 and magnetically released by the solenoid 426, the upward displacement of brake arm 425 by cam 421 simulates the solenoid action, displaces spring 427, and controllably releases the brake. The weight on platform 101 will cause a downward gravitational motion thereof, the extent of which is limited by the normal friction attendant to the power transmission from electric motor 401 through the speed reducing power transmission 405, 406, and 407. Accordingly, under the manual cable override situation, the platform 101 will drift slowly and safely to the bottom of the staircase. Such situation may occur either due to electrical power failures, or due to an electrical interrupt of the character set forth herein.

Figure 5C:
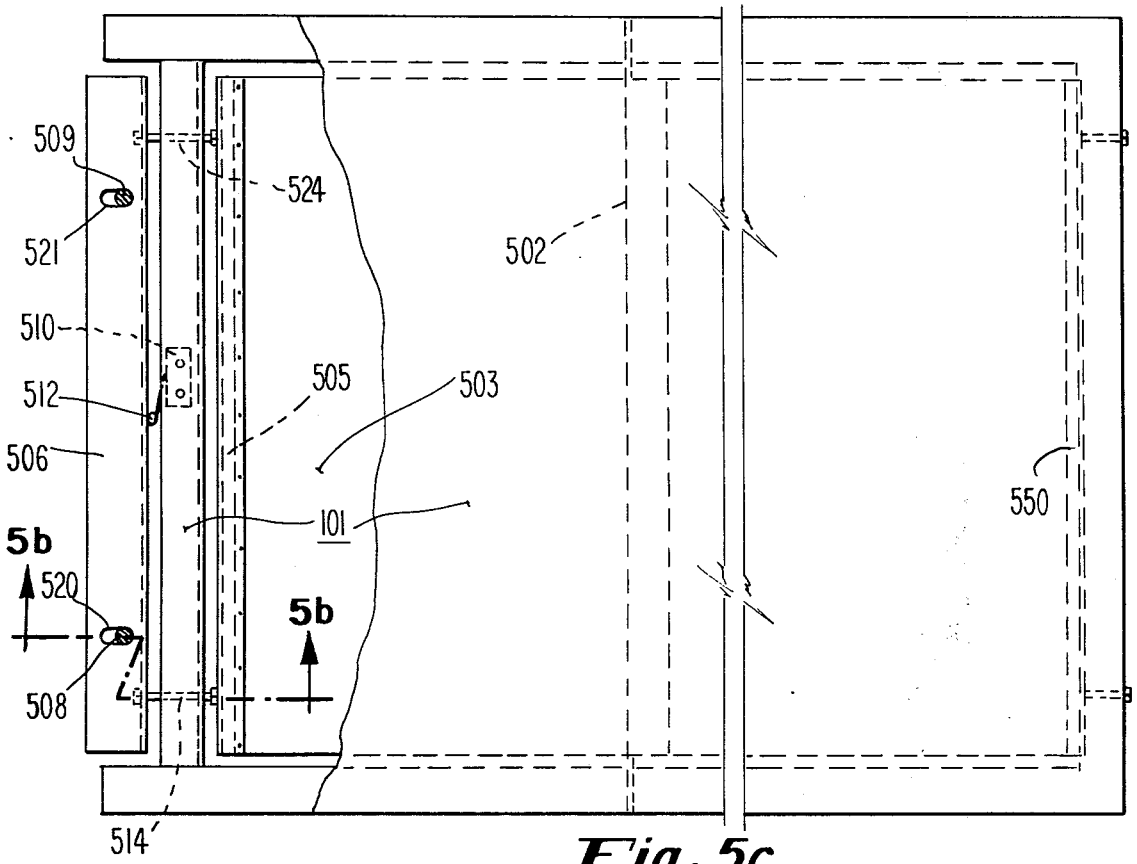
FIGS. 5*a*, 5*b* and 5*c* show a preferred construction of an elevator platform in accordance with the principles of the present invention.
Figure 5A:
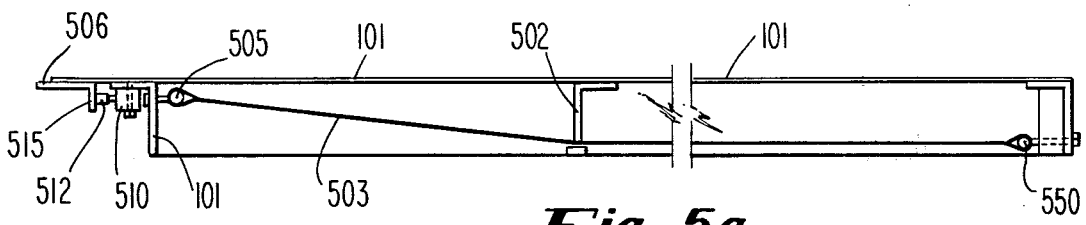
Figure 5B:
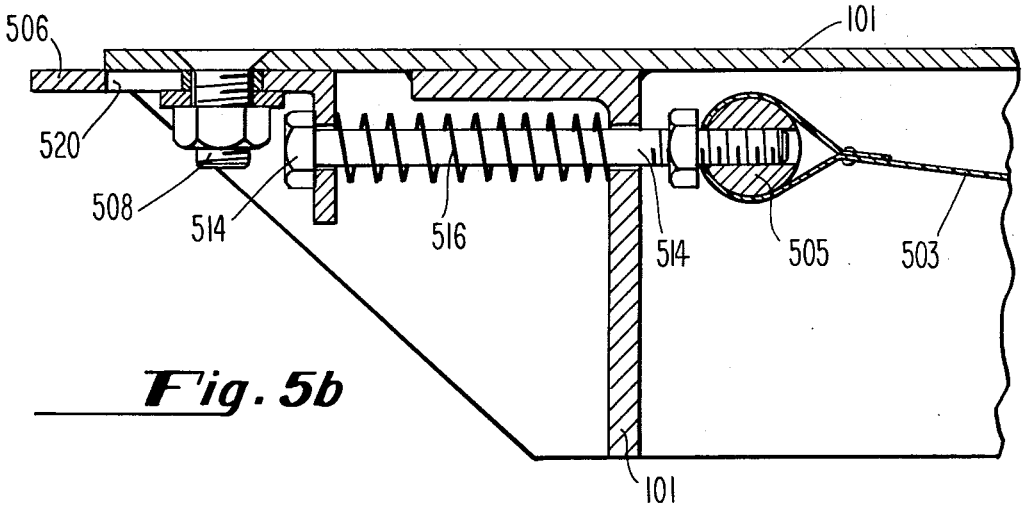

With reference to FIGS. 5*a* through 5*c*, there are shown views of a preferred configuration for the platform 101. Specifically, FIG. 5*a* shows a partial side cut away, FIG. 5*c* shows a partial top cut away, and FIG. 5*b* shows a close up cross section of a portion of the FIG. 5*c* apparatus.

The embodiment shown in FIGS. 5*a* through 5*c* represents yet another safety precaution, which accounts for objects on the staircase in the path of the upwardly or downwardly moving elevator platform. It will be appreciated that when the platform is moving upwardly, the front extremity thereof will be the first to contact any obstruction and to account for it, an angular bumper 506 is provided which will be pressed toward the main platform 101, and will operate a switch 510 to disconnect the power. As shown in FIGS. 5*b* and 5*c*, the bumper element 506 is carried on platform 101 by means of bolt elements 508 and 509 which are attached to platform 101 and which depend downwardly through slots 520 and 521 in the bumper element 506. The downwardly depending portion 515 of bumper 506 is penetrated by bolts 514 and 524, and springs such as 516 in FIG. 5*b* maintain the bumper 506 in the outward position. Should, however, an obstruction be encountered by bumper 506, the spring 516 will be compressed and the downward flange 515 of bumper 506 will deflect the spring lever 512 of switch 510, and thereby disconnect the power (through the cables reeled at 109).

Should the platform encounter an obstruction during its downward movement on the stairway, it is conceivable that that obstruction could be at any point along the length of the platform, and the embodiment of FIGS. 5*a* through 5*c* accounts for an obstruction at any such location. In particular, a tensioned, flexible nonstretchable apron 503, advantageously of vinyl, is stretched between a fixed point defined by rod 550 at the back of the platform and a moveable point at the front. In particular, the movable point comprises a rod 505 which is attached to the bolts 514 and 524 described hereinbefore with respect to the bumper 506. Apron 503 is maintained in its tensioned state by elements such as 502 depending downwardly from platform 101. Should an obstruction occur beneath the platform 101 during its downward motion, apron 503 will be deflected, and will pull rod 505 and bolt 514 against switch 516. Such translation of bolt 514 also moves bumper 506 toward the main platform, and flange 515 engages and deflects spring arm 512 of switch 510. Again, the power is thereby disconnected.

It will be apparent from the foregoing that embodiments of the present invention provide compactness and rigidity called for in the objects set forth herein. Further, the construction utilized is convenient, flexible, and safe to use even for handicapped and the like persons. It will be apparent that numerous alternative embodiments will occur to those of ordinary skill in the art without departure from the spirit or the scope of the present invention. Most especially, the present invention may be directed to vertical elevator systems just as the embodiment shown herein is directed to an inclined system. Further, numerous design options with respect to the construction, configuration, and interconnection of the various elements comprising the present invention may be altered by those of ordinary skill without departure from the spirit or the scope of the present invention.

I claim:

1. An elevator system comprising:

a. at least one track means including, i. a first tubular member having a longitudinal slot along an upper first surface, and ii. a lower second tubular member within and along a second surface of said first member opposite said first surface;

b. trolley means within the first tubular member of said track means, said trolley means having an upper roller means bearing against the inside of said first surface of said first tubular member, and a lower roller means bearing against an upper outer surface of said second tubular member;

c. an elevator platform connected to and movable with said trolley means through said slot in said first tubular member; and d. a continuous chain drive including, i. drive means at an extremity of said track means, and ii. a chain, powered by said drive means and having its ends respectively connected to opposite ends of said trolley means, said chain passing through said second tubular member and providing upward and downward movement for said platform.

2. An elevator system as described in claim 1, wherein said first and second tubular members are generally rectangular in cross section, thereby defining a generally rectangular passageway inside said first member but outside said second member, and wherein said trolley means is located in said passageway.

3. An elevator system as described in claim 2, wherein said trolley means comprises an elongated extension of said platform through said slot and into said passageway, wherein said upper roller means includes a roller on each side of said extension near the upstairs extremity of said extension, bearing upwardly against the inside of said first surface straddling said slot, and wherein said lower roller means includes a roller on each side of said extension near the downstairs extremity of said extension, bearing downwardly against said second tubular member.

4. An elevator system as described in claim 2, wherein said trolley means comprises an elongated extension of said platform through said slot and into said passageway, a serrated pawl pivotably connected to the upper extremity of said extension, and spring means urging said pawl against a wall of said passageway, said chain having one end connected directly to the lower extremity of said extension, and having its other end connected to said pawl in pivotable opposition to said spring means.

5. An elevator system as described in claim 1, wherein said second tubular member further includes an electrical conduit interconnecting said platform and said drive means.

6. An elevator system as described in claim 5, wherein said platform comprises switch means for disabling said drive means, bumper means adjacent said track means, and a tensioned, flexible cover spaced away from the underside of said platform, said switch means being operated by contact of said bumper means or of said cover with objects on said stairway.

7. An elevator system as described in claim 5, wherein said track means includes switch means located at the top and bottom extremities of said track means, for disabling said drive means, said switch means being operated by contact of said trolley means upon arrival of said platform at said extremities.

8. An elevator system as described in claim 1, and adapted for inclined operation on a staircase, said track means being mounted to the toes of the steps of said staircase and said platform depending horizontally outwardly from its connection point with said trolley.

9. An elevator system as described in claim 8, and further including brake means responsive to a power loss at said drive means, for stopping movement of said platform, and a cable release for said brake means, said cable being attached along the exterior of said track means within reach from said platform.

10. An elevator system as described in claim 1, wherein said drive means includes a plurality of sequential sprockets at said extremity of said track means, one of said sprockets being power driven and the others of said sprockets being free turning and spring tensioned against said chain, said drive means further including switch means for disabling said power driven sprocket upon breakage of said chain and consequent spring displacement of one of said others of said sprockets.

11. An elevator system as described in claim 1, including two substantially parallel ones of said track means, each said track means having one of said trolley means connected to said platform, and each said track means having one of said chains, said drive means being adapted simultaneously to power both of said chains.

12. An elevator system as described in claim 11, wherein said track means are substantially vertical, and wherein said platform is substantially horizontal.

* * * * *